US006135173A

United States Patent [19]

Lee et al.

[11] Patent Number: 6,135,173

[45] Date of Patent: Oct. 24, 2000

[54] ICE DISPENSER FOR REFRIGERATOR

[75] Inventors: Byoung-In Lee, Seoul; Joon-Dong Ji, Suwon, both of Rep. of Korea

[73] Assignee: SamSung Electronics Co., Ltd., Suwon, Rep. of Korea

[21] Appl. No.: 09/259,677

[22] Filed: Mar. 1, 1999

[30] Foreign Application Priority Data

| | | | |
|---|---|---|---|
| Mar. 3, 1998 | [KR] | Rep. of Korea | 98-6860 |
| Jul. 30, 1998 | [KR] | Rep. of Korea | 98-14260 |
| Feb. 1, 1999 | [KR] | Rep. of Korea | 99-3176 |

[51] Int. Cl.[7] ..... B65B 1/04

[52] U.S. Cl. ..... 141/361; 141/351; 141/362; 222/146.6; 222/477; 62/266; 62/344

[58] Field of Search ..... 141/351, 360–362; 222/146.6, 477; 62/266, 344

[56] References Cited

U.S. PATENT DOCUMENTS

| | | | |
|---|---|---|---|
| 3,537,132 | 11/1970 | Alvarez | 62/266 |
| 3,789,620 | 2/1974 | Benasutti, et al. | 62/344 |
| 3,942,334 | 3/1976 | Pink | 62/266 |
| 4,069,545 | 1/1978 | Holet et al. | 16/49 |
| 4,090,641 | 5/1978 | Lindenschmidt | 222/70 |
| 4,220,266 | 9/1980 | Braden et al. | 222/477 |
| 4,462,437 | 7/1984 | Prada | 141/360 |
| 5,267,672 | 12/1993 | Jacobsen et al. | 222/146.6 |
| 5,279,445 | 1/1994 | Fisher et al. | 222/1 |
| 5,526,854 | 6/1996 | Unger | 141/351 |
| 5,860,564 | 1/1999 | Jablonski | 221/303 |

FOREIGN PATENT DOCUMENTS

| | | |
|---|---|---|
| 52-132460 | 10/1977 | Japan . |
| 55-39414 | 3/1980 | Japan . |
| 56-65369 | 6/1981 | Japan . |
| 56-60067 | 8/1981 | Japan . |

*Primary Examiner*—J. Casimer Jacyna
*Attorney, Agent, or Firm*—Robert E. Bushnell, Esq.

[57] ABSTRACT

An ice dispenser for a refrigerator includes an ice reservoir mounted inside the refrigerator, an ice supplier disposed within the ice reservoir, a cavity mounted in a refrigerator door, an ice supply tube communicating the ice reservoir with the cavity, a damper door for opening and closing the ice supply tube, and an elastic member biasing the damper door toward the ice supply tube closing position. A mounting lever pivotally fixed on the cavity, a damper door opening lever extending from an extreme end of the mounting lever to one side of the damper door, a switch operating lever extending from the extreme end of the mounting lever, and a switch operated by a pivotal movement of the switch operating lever are provided. A retardation means for retarding the return of the damper door to the closed position for a predetermined time after pieces of ice are dispensed out of the cavity and the switch is turned OFF is also provided. A retardation release means for releasing the retardation of the return of the damper door after the predetermined time has elapsed is further provided.

16 Claims, 8 Drawing Sheets

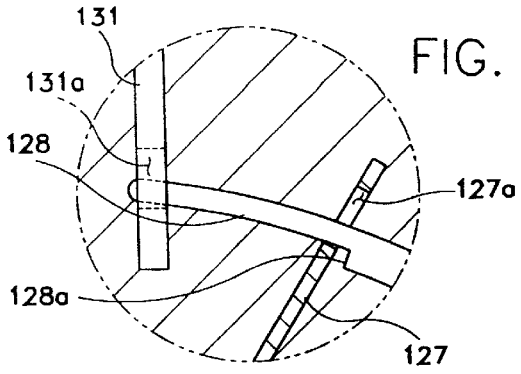
FIG. 4B
FIG. 4A
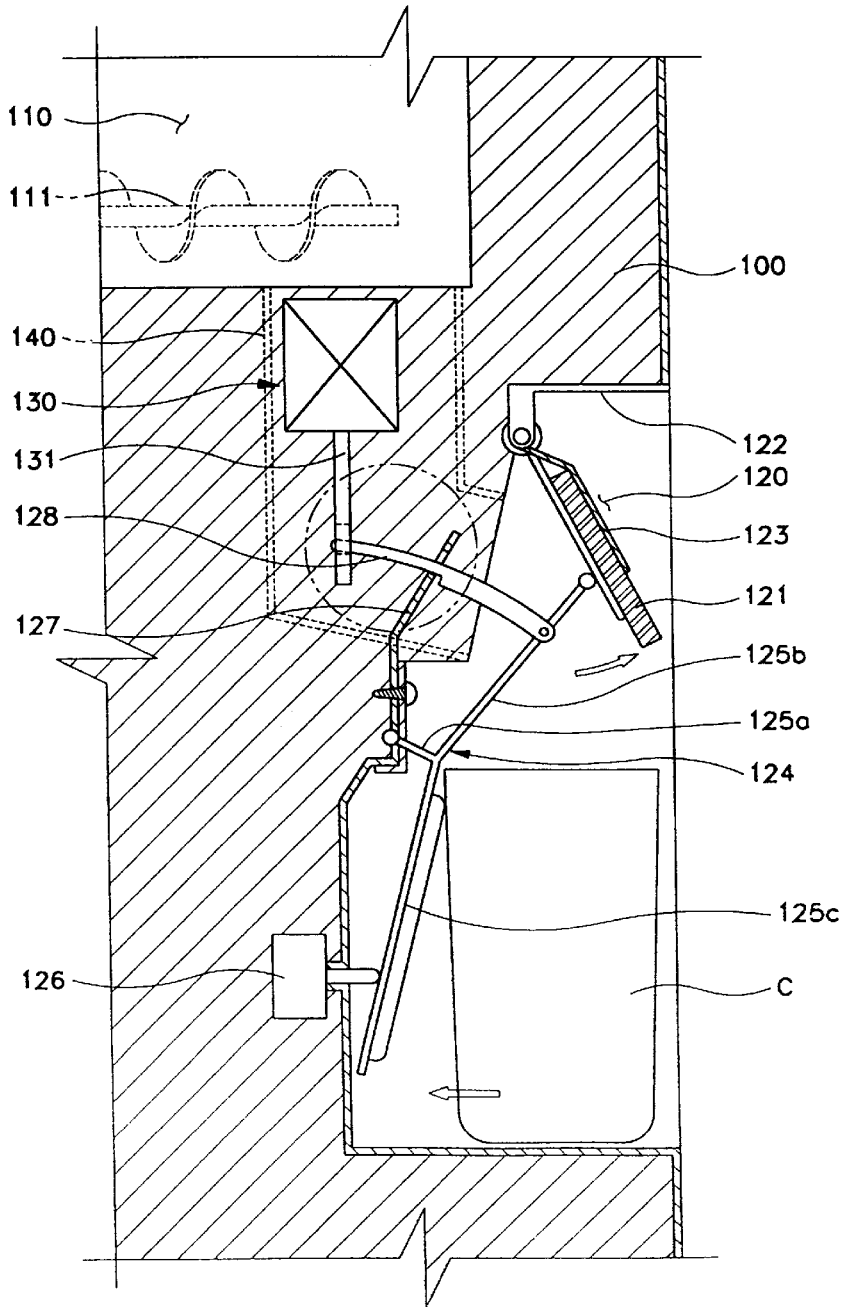

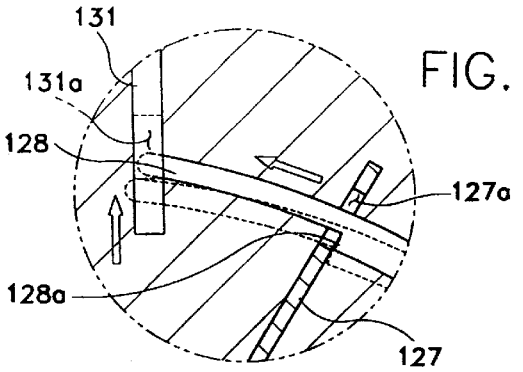
FIG. 5B
FIG. 5A
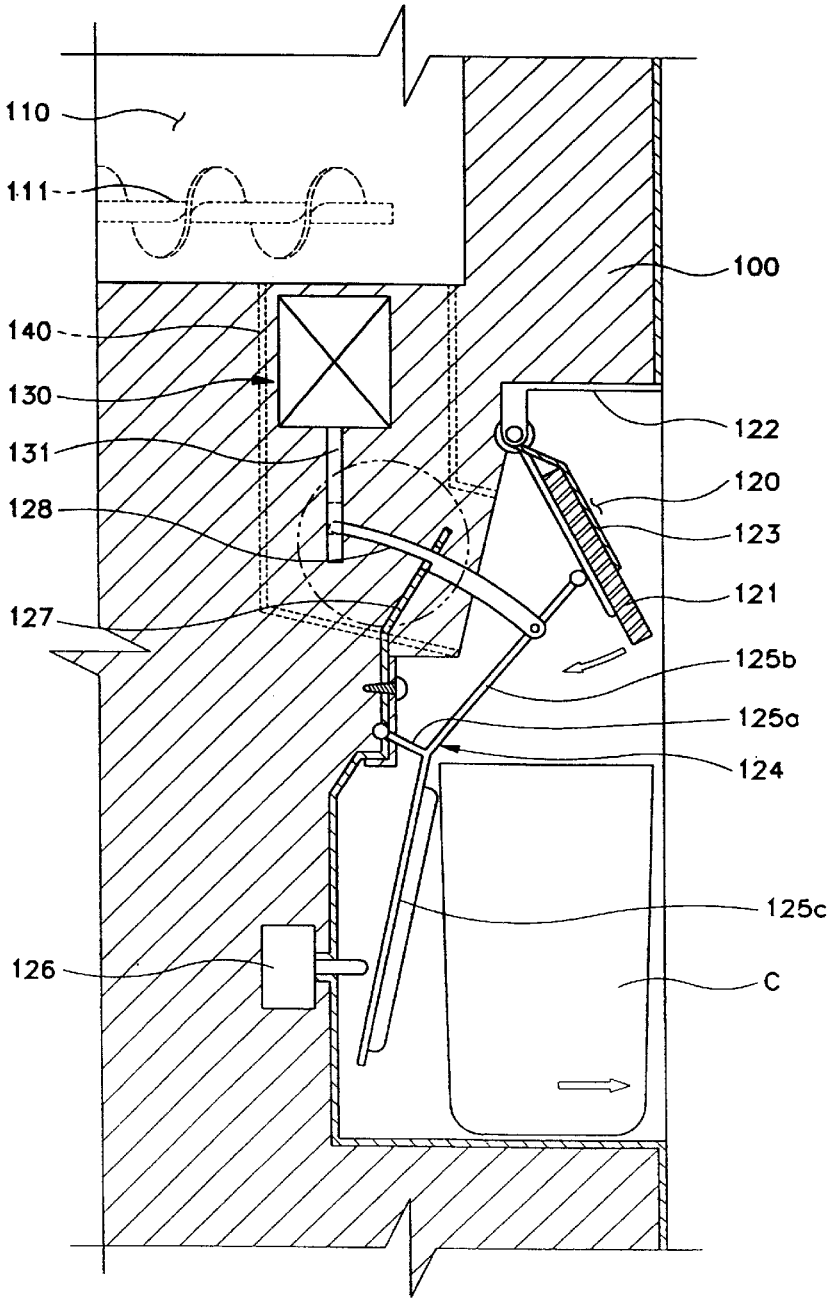

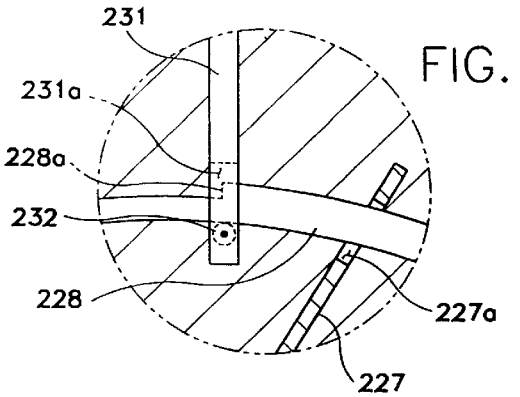
FIG. 6B
FIG. 6A
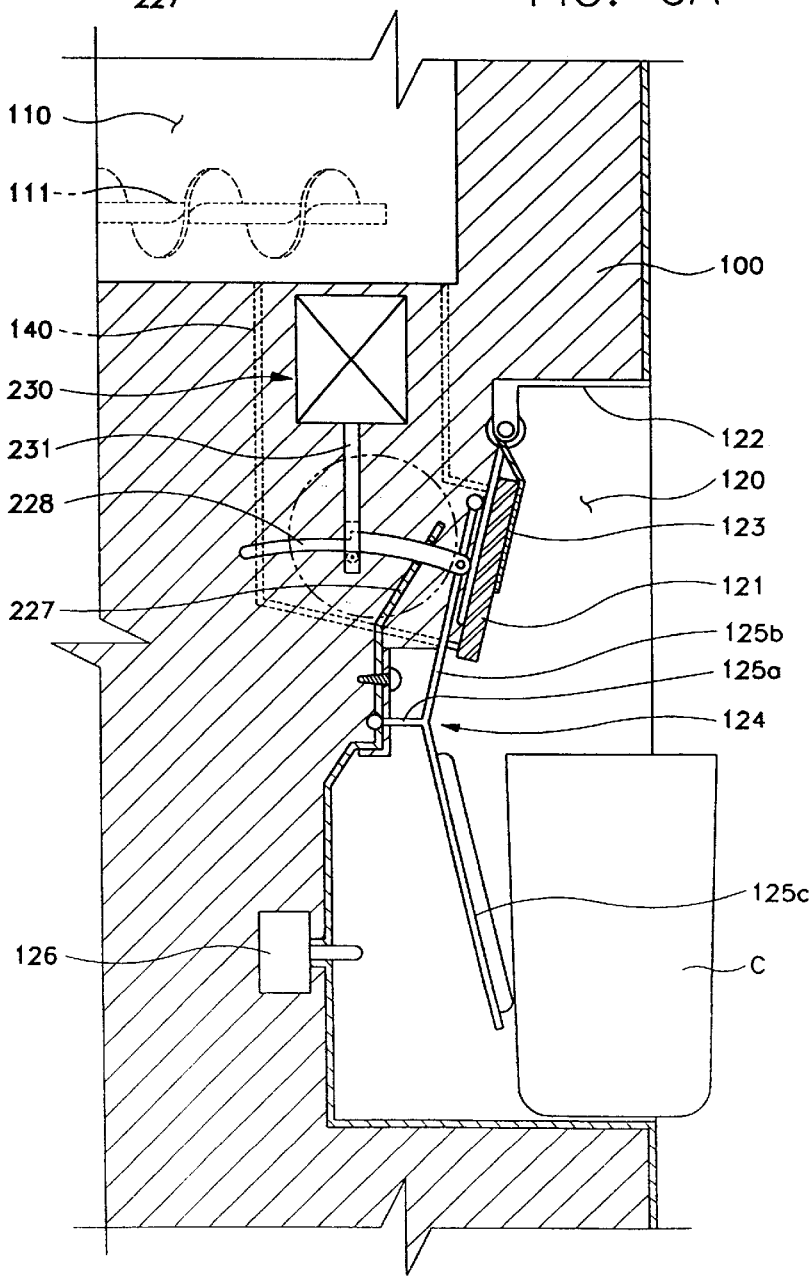

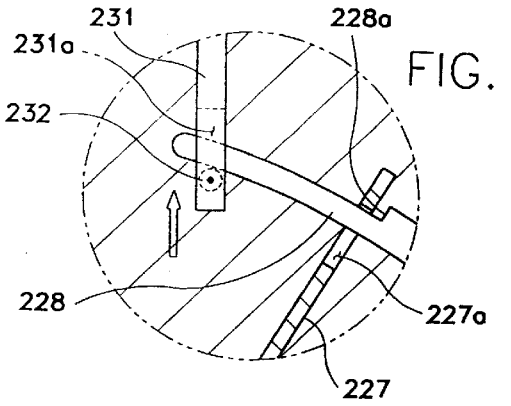
FIG. 7B
FIG. 7A
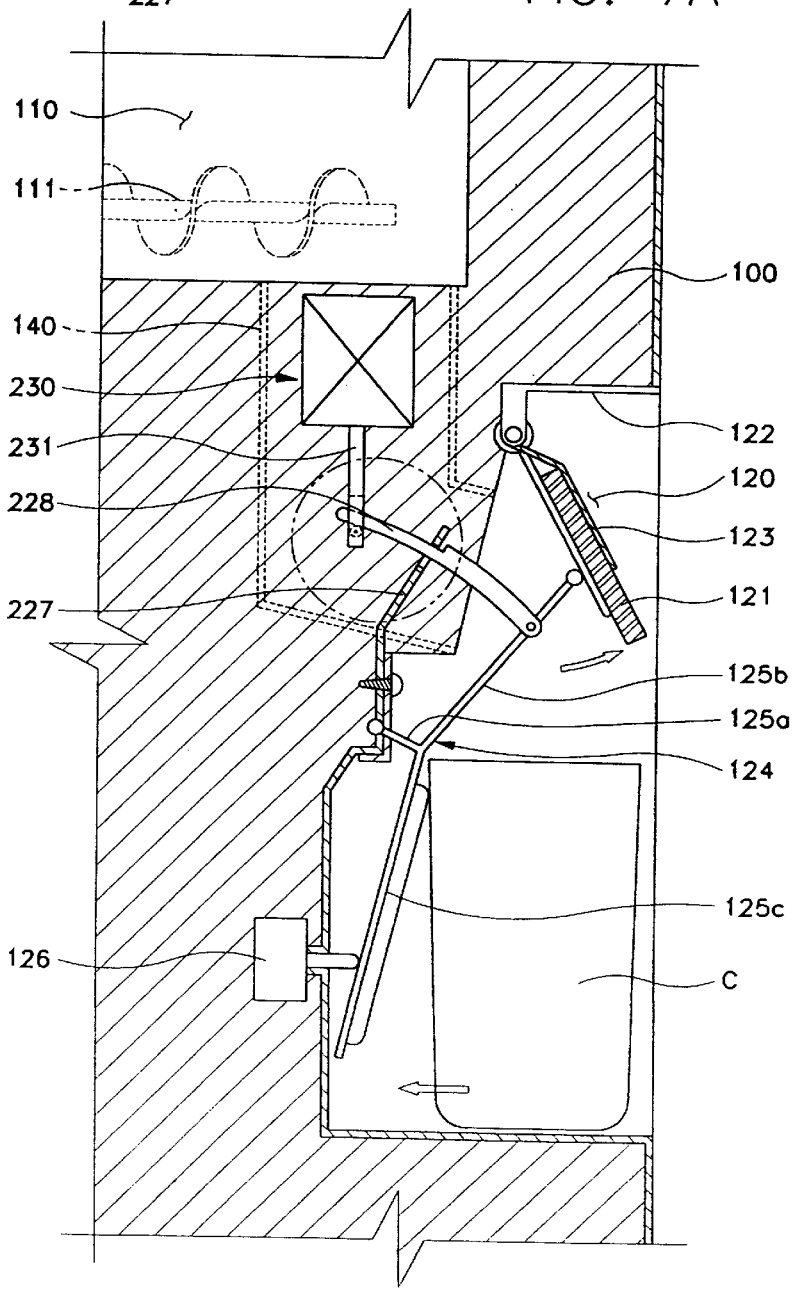

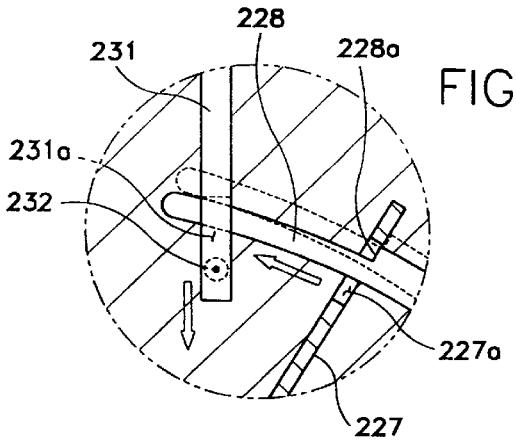
FIG. 8B
FIG. 8A
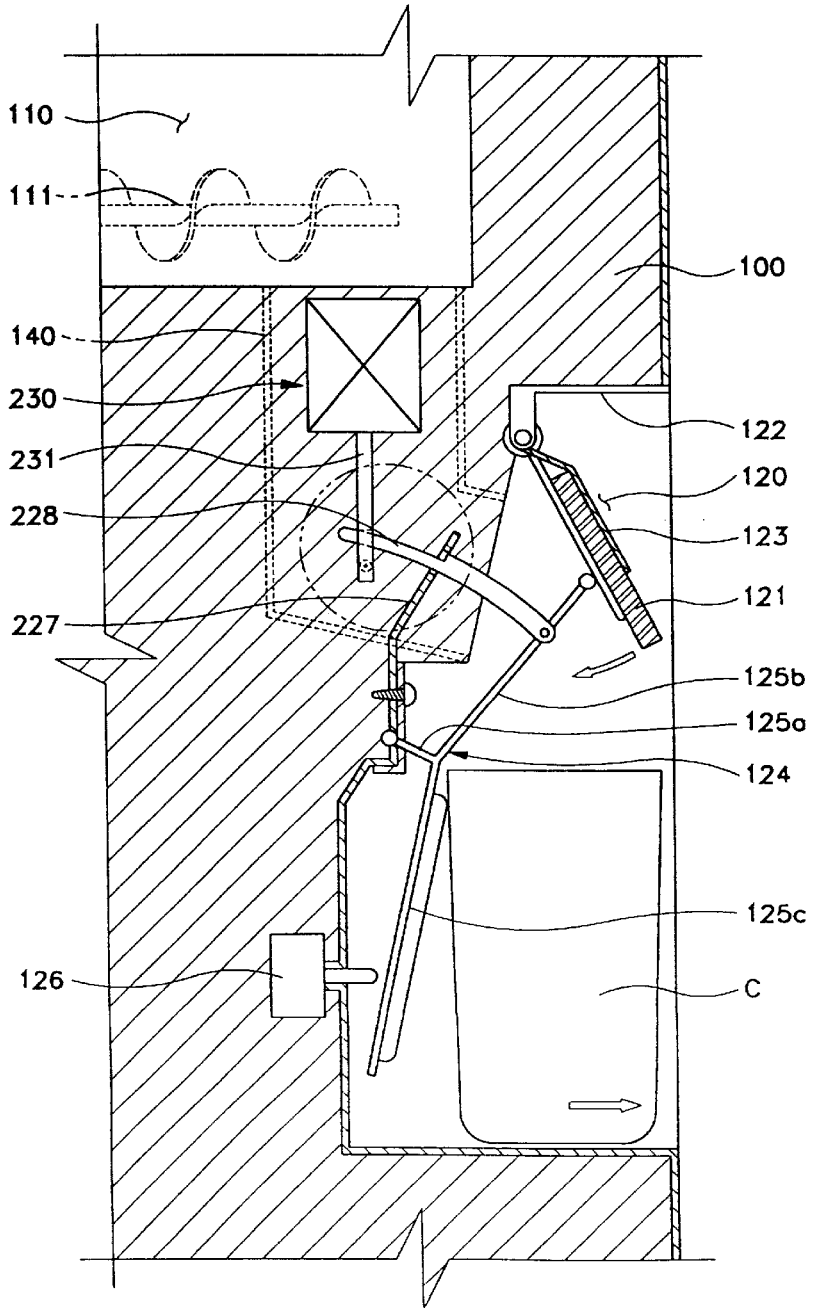

ICE DISPENSER FOR REFRIGERATOR

CLAIM OF PRIORITY

This application makes reference to, incorporates the same herein, and claims all benefits accruing under 35 U.S.C. §119 from an application entitled *Ice Dispenser for Refrigerator* earlier filed in the Korean Industrial Property Office on Mar. 3, 1998, and there duly assigned Ser. No. 98-6860, by that Office, an application entitled *Ice Dispenser for Refrigerator* earlier filed in the Korean Industrial Property Office on Jul. 30, 1998, and there duly assigned Ser. No. 98-14260, by that Office, and an application entitled *Ice Dispenser for Refrigerator* earlier filed in the Korean Industrial Property Office on Feb. 1, 1999, and there duly assigned Ser. No. 99-3176, by that Office.

BACKGROUND OF THE INVENTION

1. Field of the Invention

The present invention relates to refrigerators, more particularly to refrigerators having product storage and dispensing, and more specifically to an ice dispenser for a refrigerator.

2. Description of the Related Art

A refrigerator is a large container that is usually powered by electricity to be kept cool inside so that food and drinks in it stay fresh. In recent years, through-the-door ice and beverage dispensers have been developed for refrigerators that can provide a user with a beverage and pieces of ice without opening a door of the refrigerator. In addition to convenience, this has the benefit that cool air is prevented from leaking out of the refrigerator.

In one conventional through-the-door ice dispenser, an ice reservoir in which an ice supplier is mounted is disposed inside a refrigerator. Defined on a front side of a refrigerator door is a cavity for receiving a cup. The ice reservoir communicates with the cavity through an ice supply tube so that pieces of ice can be supplied to the cup from the ice reservoir through the ice supply tube.

Fixedly mounted on a top surface of the cavity is a bracket to which a damper door for opening/closing the ice supply tube is pivotally connected. An elastic member is supported on the bracket to bias the damper door toward an ice supply tube closing position when the dispenser is not operating.

The dispenser further comprises a first lever having a first end disposed on one side of the damper door and a second end pivotally coupled to an inner wall of the cavity, and a second lever integrally branched off and extended downward from the first lever. That is, the second lever is disposed such that as the cup is inserted into the cavity it is moved inward so that the first lever pivots to open the ice supply tube while overcoming biasing force of the elastic member.

Meanwhile, a switch for operating the ice supplier is mounted inside the door, the switch being operated by the second lever. That is, the switch is turned ON while the second lever is pushed by the cup toward the inner wall of the cavity to operate the ice supplier, thereby dispensing pieces of ice from the ice reservoir to the cup through the ice supplying tube.

When the cup is withdrawn out of the cavity after being supplied with pieces of ice, the switch is turned OFF so that the operation of the ice supplier is stopped, and at the same time, the damper door is returned toward its closed position by biasing force of the elastic member, thereby closing the ice supply tube. At this point, if the damper door abruptly closes the ice supply tube, many pieces of ice which are being supplied through the ice supply tube may remain within the ice supply tube. To solve this problem, a retarder is provided facing the damper door for retarding the return of the damper door to the closed position. The retarder includes a retarder housing defined by a portion of the inner wall of the cavity, a piston slidably disposed in the retarder housing, and a rod coupled at its one end to the first lever and at the other end to the piston. The rod is drawn out of the retarder when the damper door is opened, and when the damper door is closed, the rod is inserted into the retarder housing by biasing force of the elastic member. At this point, the damping force of the retarder retards the return of the damping door to the closed position.

However, in the above described conventional ice dispenser, since the damping force of the retarder changes over time, in particular lessening over the life of the device, the retardation time during the return of the damping door to the closed position is shortened, causing the ice supplying tube to be too quickly closed. As a result of this, pieces of ice may be caught at an outlet of the ice supply tube by the damper door or remain within the ice supply tube, lowering the reliability of the dispenser.

Other examples of the conventional art are seen, for example, in the following U.S. patents. U.S. Pat. No. 3,537,132, to Alvarez, entitled *Household Refrigerator With Through-The-Door Ice Service*, describes a ice dispenser with a time delay to keep a trap door open for a few seconds after discharging the ice. The illustrated time delay mechanism is a dash pot, and such a device can undergo the loss of reliability with time described above.

U.S. Pat. No. 3,942,334 to Pink, entitled *Door Delay Closing Mechanism For The Ice Chute From A Power Driven Ice Dispenser In A Freezer-Refrigerator*, describes a spring-loaded door of the ice chute of a freezer-refrigerator with a delay mechanism to prevent ice from remaining in the chute. The mechanism uses a mechanical inertia motor to delay the door closing. Such a mechanical device may undergo loss of reliability with use over time.

U.S. Pat. No. 4,069,545 to Holet et al., entitled *Door Control Device With Closure Regulator*, discloses a device for slowing the closure of a door of an automatic ice maker. The door is clutched to a rotor positioned within a stator. The stator contains a fixed volume compartment with a viscous fluid, and the fluid impedes rotation of the rotor. Such a device may be subject to loss of reliability over time.

U.S. Pat. No. 4,090,641, to Lindenschmidt, entitled *Refrigerator Ice Door Mechanism*, describes an ice chute door with a conventional time delay means to delay the closing of the door. This means is a mechanical delay device which is cocked when the door is opened. As described above, such a mechanical device is subject to loss of reliability.

U.S. Pat. No. 4,220,266 to Braden et al., entitled *Ice Door Delay Mechanism*, describes a delay mechanism including a suction cup which attaches to a planar surface to hold the ice door open. An air-bleed mechanism provides a delay until sufficient air has entered the suction cup for suction to be lost.

U.S. Pat. No. 4,462,337, to Prada, entitled *Door Control Device With Closure Regulator*, discloses a device for slowing and impeding the closing movement of an ice dispenser door. The device includes a sealed flexible container containing a viscous fluid and rollers engaging the container. Deformation of the container by the rollers is slowed by the viscous fluid to provide the slowing mechanism.

U.S. Pat. No. 5,279,445, to Fisher, entitled *Cable Operated Ice Dispensing Door*, describes the door mechanism of an ice chute for a convenience store beverage dispenser. The door is operated by a solenoid operating a piston which moves a link and lug to lift or lower a plate and the door. Alternatively, the solenoid may operate a piston which moves a cable through a pulley system to operate the door. This invention was an attempt to solve the problem of premature wear on solenoids in link-operated doors due to the lateral stress on the solenoids, and the problem of providing the pull strength necessary to directly operate the door. The device requires a solenoid of sufficient power to open the door. Moreover, this invention deals with preventing ice spillage, that is, continued flow of ice after the receiving cup is pulled away. Thus, the invention does not deal with the delay in door closing desired in the through-the-door ice dispenser.

U.S. Pat. No. 5,860,564, to Jablonski, entitled *Ice Dispensing Chute*, describes an ice dispensing chute mechanism for an ice dispensing machine, in which a solenoid drives a rod to open and close a door on the ice bin. In this mechanism the door retains the ice in the bin. As above, this invention requires a solenoid of sufficient power to open the door, and does not deal with a mechanism for delaying the closing of the door after a switch is released, as is desirable for the refrigerator in-door dispenser.

U.S. Pat. No. 5,526,854, to Unger, entitled *Through The Door Water And Ice Dispenser*, discloses a door for an ice chute of a through-the-door dispenser. In this patent, a dispenser comprises a damper door for opening/closing an ice supply tube and an actuator for pivoting the damper door between a closed position and an opened position. The actuator includes a piston and a spring biasing the piston. Mounted between the damper door and the actuator is an arm coupled at its one end to the damper door to pivot about a pivot shaft together with the damper door and at the other end to the piston of the actuator. In more detail, when a cup is inserted into a cavity to turn a switch ON, thereby the actuator being electrically energized, fluid within the actuator is caused to vaporize and extend the piston against the internal spring. When withdrawing the cup out of the cavity, thereby the actuator being de-energized, the vapor commences to cool, and after a delay, the internal spring moves the piston back to its retracted position causing the damper door to return to its closed position. Since there is a delay in the closing operation after the dispenser is de-actuated, sufficient time is allowed to permit all pieces of ice to be exhausted out of the ice supply tube.

However, in the Unger dispenser, to maintain the damper door in an opened state, electric power is continually applied to the actuator and a relatively large amount of operating force of the actuator is required to completely open and close the damper door, thereby increasing electric power consumption. In addition, to allow the damper door to tightly contact an outlet of the ice supply tube when the damper door is closed, since a spring having a high elastic coefficient is required, the capacity of the actuator has to be large to operate the piston against the spring having the high elastic coefficient.

Based on our reading of the art, then, we have decided that what is needed is an ice chute of a through-the-door refrigerator with a delayed damper door closing mechanism which does not lose its reliability over time, as do many mechanical delay devices. Our reading of the art indicates that electrical actuators which directly operate the damper door are subject to wear and reliability problems, and in addition consume excessive electrical power. What is needed then is a mechanism which does not suffer from these deficiencies.

SUMMARY OF THE INVENTION

Therefore, it is an object of the present invention to provide an improved ice dispenser for a refrigerator.

It is a further object to provide an ice dispenser with an improved mechanism for delaying the closing of the ice chute damper.

It is a yet further object of the invention to provide a damper delay mechanism which has high reliability and a long operational lifetime.

It is a still further object of the invention to provide a damper delay mechanism which consumes little electric power.

It is a yet still further object of the invention to provide a damper delay mechanism which does not require a high capacity actuator.

The present invention has been made in an effort to solve the above described problems. To achieve the above objectives, the present invention provides an ice dispenser for a refrigerator which comprises an ice reservoir mounted inside the refrigerator, an ice supplier disposed within the ice reservoir, a cavity mounted in a refrigerator door, an ice supply tube communicating the ice reservoir with the cavity, a damper door for opening and closing the ice supply tube, an elastic member biasing the damper door toward the ice supply tube closing position, a mounting lever pivotally fixed on the cavity, a damper door opening lever extending from an extreme end of the mounting lever to one side of the damper door, a switch operating lever extending from the extreme end of the mounting lever, a switch operated by a pivotal movement of the switch operating lever, a retardation means for retarding the return of the damper door to the closed position for a predetermined time after pieces of ice are dispensed out of the cavity and the switch is turned OFF, and a retardation release means for releasing the retardation of the return of the damper door after the predetermined time has elapsed.

According to an embodiment of the present invention, the retardation means comprises a stopper, or stop bar, pivotally coupled to one end of the damper door opening lever and a supporting bracket for restricting an movement of the stopper, and the retardation release means comprises a solenoid for elevating/lowering the stopper.

The supporting bracket is provided with a slot through which the stopper passes, and the solenoid is provided with a plunger connected to the stopper. The stopper is provided with a detent step for being caught on the supporting bracket when the damper door is moved toward the closed position, the detent step being formed on a lower side of the stopper.

The solenoid is designed to elevate the plunger and the stopper after the predetermined time has elapsed so that the detent caught on the supporting bracket passes through the slot of the supporting bracket. The solenoid is disposed above the stopper. The plunger is provided with a through hole through which the stopper passes.

According to another embodiment of the present invention, the stopper is provided with a detent step for being caught on the supporting bracket when the damper door moved toward the closed position, the detent step being formed on an upper side of the stopper. The solenoid is designed to elevate the plunger and the stopper after the switch is turned ON and pieces of ice start being dispensed to the cavity so that the detent is caught on the supporting bracket.

The solenoid is designed to lower the plunger and the stopper after the predetermined time has elapsed since the switch is turned OFF so that the detent caught on the supporting bracket passes through the slot of the supporting bracket. The solenoid is disposed above the stopper. The plunger is provided with a through hole through which the stopper passes. A roller for smoothly moving the stopper is mounted on the through hole.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 4A is a side sectional view of an ice dispenser, in which a damper door is opened, according to a first preferred embodiment of the present invention;

FIG. 4B is an enlarged view of a circled portion of FIG. 4A;

FIG. 5A is a side sectional view of an ice dispenser, in which a damper door closing retardation state is released, according to a first preferred embodiment of the present invention;

FIG. 5B is an enlarged view of a circled portion of FIG. 5A;

FIG. 6A is a side sectional view of an ice dispenser, in which a damper door is closed, according to a second preferred embodiment of the present invention;

FIG. 6B is an enlarged view of a circled portion of FIG. 6A;

FIG. 7A is a side sectional view of an ice dispenser, in which a damper door is opened, according to a second preferred embodiment of the present invention;

FIG. 7B is an enlarged view of a circled portion of FIG. 7A;

FIG. 8A is a side sectional view of an ice dispenser, in which a damper door closing retardation state is released, according to a second preferred embodiment of the present invention; and FIG. 8B is an enlarged view of a circled portion of FIG. 8A;

DETAILED DESCRIPTION OF THE PREFERRED EMBODIMENTS

Figure 1:
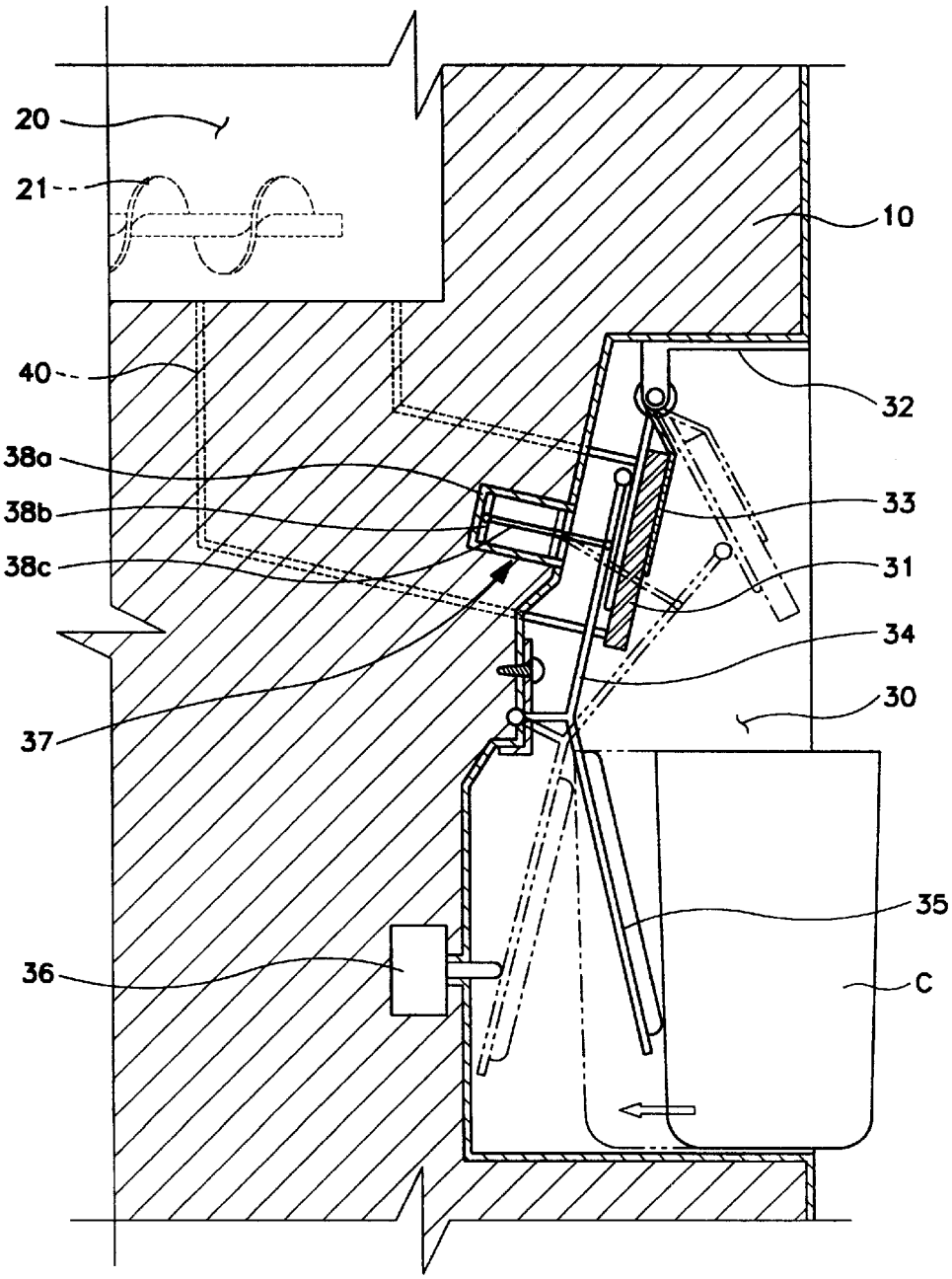
FIG. 1 (PRIOR ART)
FIG. 1 is a schematic side sectional view illustrating a conventional ice dispenser.

Turning now to the drawings, the conventional ice dispenser discussed above is shown in FIG. 1. An ice reservoir 20 in which an ice supplier 21 is mounted is disposed inside a refrigerator. Defined on a front side of a refrigerator door 10 is a cavity 30 for receiving a cup C. The ice reservoir 20 communicates with the cavity 30 through an ice supply tube 40 so that pieces of ice can be supplied to the cup C from the ice reservoir 20 through the ice supply tube 40.

Fixedly mounted on a top surface of the cavity 30 is a bracket 32 to which a damper door 31 for opening/closing the ice supply tube 40 is pivotally connected. An elastic member 33 is supported on the bracket 32 to bias the damper door 31 toward an ice supply tube closing position when the dispenser is not operating.

The dispenser further comprises a first lever 34 having a first end disposed on one side of the damper door 31 and a second end pivotally coupled to an inner wall of the cavity 30, and a second lever 35 integrally branched off and extended downward from the first lever 34. That is, the second lever 35 is disposed such that as the cup C is inserted into the cavity 30 it is moved inward so that the first lever 35 pivots to open the ice supply tube 40 while overcoming biasing force of the elastic member 33 (see FIG. 1 elements in phantom).

Meanwhile, a switch 36 for operating the ice supplier 21 is mounted inside the door 10, the switch 36 being operated by the second lever 35. That is, the switch 36 is turned ON while the second lever 35 is pushed by the cup C toward the inner wall of the cavity 30 to operate the ice supplier 21, thereby dispensing pieces of ice from the ice reservoir 20 to the cup C through the ice supplying tube 40.

When the cup C is withdrawn out of the cavity 30 after being supplied with pieces of ice, the switch 36 is turned OFF so that the operation of the ice supplier 21 is stopped, and at the same time, the damper door 31 is returned toward its closed position by biasing force of the elastic member 33, thereby closing the ice supply tube 40. At this point, if the damper door 31 abruptly closes the ice supply tube 40, many pieces of ice which are being supplied through the ice supply tube 40 may remain within the ice supply tube 40. To solve this problem, provided facing the damper door 10 is a retarder 37 for retarding the return of the damper door 10 to the closed position. The retarder 37 comprises a retarder housing 38*a* defined by a portion of the inner wall of the cavity 30, a piston 38*b* slidably disposed in the retarder housing 38*a*, and a rod 38*c* coupled at one end to the first lever 34 and at the other end to the piston 38*b*. The rod 38*c* is withdrawn out of the retarder 37 when the damper door 31 is opened, and when the damper door 31 is closed, the rod 38*c* is inserted into the retarder housing 38*a* by biasing force of the elastic member 33. At this point, damping force of the retarder 37 retards the return of the damper door 31 to the closed position.

However, in the above described conventional ice dispenser, since the damping force of the retarder 37 changes over the life of the device, the retardation time during the return of the damper door 31 to the closed position is shortened, causing the ice supplying tube 40 to be too quickly closed. As a result of this, pieces of ice may be caught at an outlet of the ice supply tube 40 by the damper door 31 or remain within the ice supply tube 40, lowering the reliability of the dispenser.

Figure 2A:
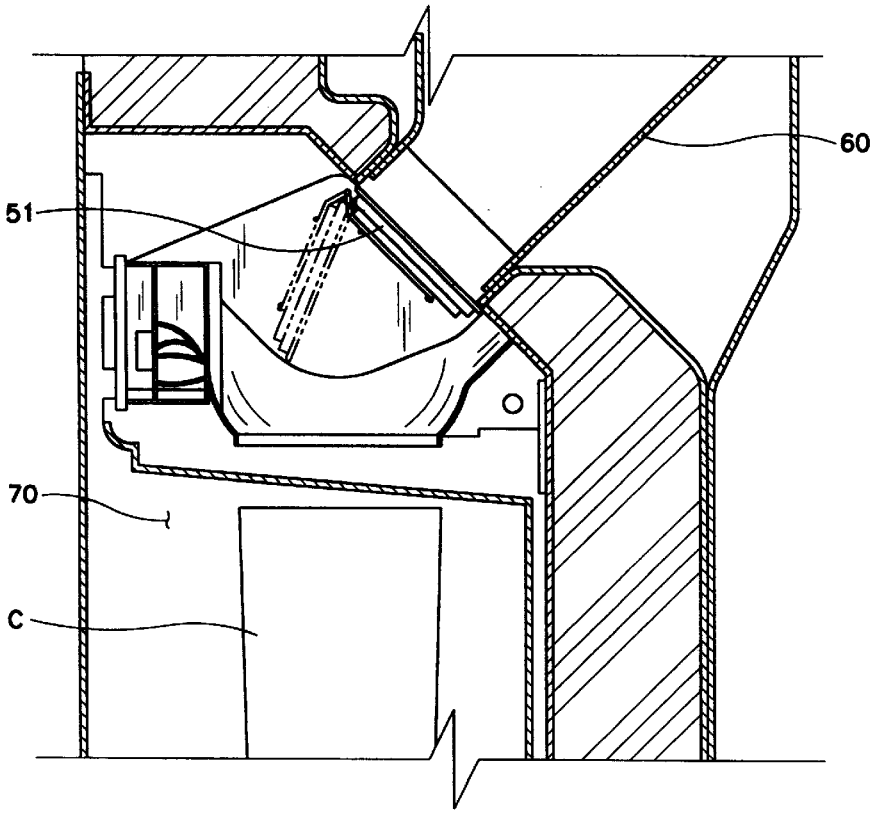
FIG. 2A (PRIOR ART)
FIG. 2A is a schematic side sectional view illustrating another conventional ice dispenser.
Figure 2B:
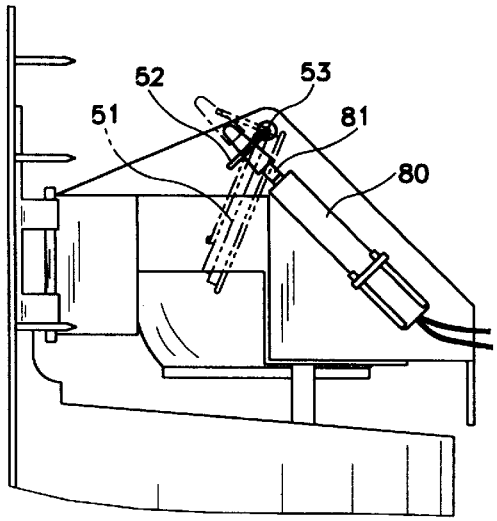
FIG. 2B (PRIOR ART)
FIG. 2B is a schematic view illustrating the operation of an operating member depicted in FIG. 2A.

The dispenser disclosed by U.S. Pat. No. 5,526,854, to Unger, discussed above, is detailed in FIGS. 2A and 2B. As shown in the drawings, a dispenser comprises a damper door 51 for opening/closing an ice supply tube 60 and an actuator 80 for pivoting the damper door 51 between a closed position and an opened position. The actuator 80 includes a piston 81 and a spring biasing the piston 81. Mounted between the damper door 51 and the actuator 80 is an arm 52 coupled at its one end to the damper door 51 to pivot about a pivot shaft 53 together with the damper door 51 and at its the other end to the piston 81 of the actuator 80. Describing this in greater detail, when a cup C is inserted into a cavity 70 to turn a switch (not shown) ON, thereby the actuator 80 being electrically energized, fluid within the actuator 80 is caused to vaporize and extend the piston 81 against the internal spring to the phantom position in FIG. 2B. When withdrawing the cup C out of the cavity 70, thereby the actuator 80 being de-energized, the vapor commences to cool, and after a delay, the internal spring moves the piston 81 back to its retracted position causing the damper door 51 to return to its closed position. Since there is a delay in the closing operation after the dispenser is de-actuated, sufficient time is allowed to permit all pieces of ice to be exhausted out of the ice supply tube 60.

However, in the Unger dispenser, to maintain the damper door 51 in an opened state, electric power is continually applied to the actuator 80 and a relatively large amount of operating force of the actuator 80 is required to completely open and close the damper door 51, thereby increasing electric power consumption. In addition, to allow the damper door 51 to tightly contact an outlet of the ice supply tube 60 when the damper door is closed, since a spring having a high elastic coefficient is required, the capacity of the actuator 80 has to be large to operate the piston 81 against the spring having the high elastic coefficient.

Reference will now be made in detail to the present preferred embodiment of the invention, an example of which is illustrated in the accompanying drawings. Wherever possible, the same reference numbers will be used throughout the drawings to refer to the same or like parts.

Figure 3B:
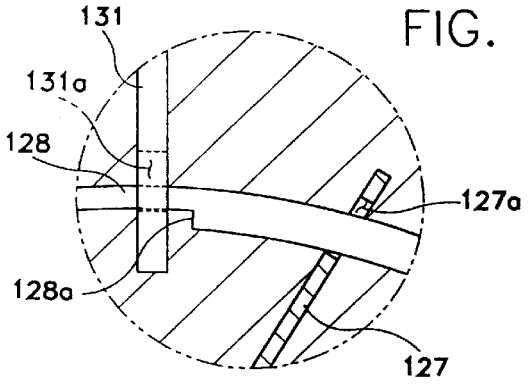
FIG. 3B is an enlarged view of a circled portion of FIG. 3A.
Figure 3A:
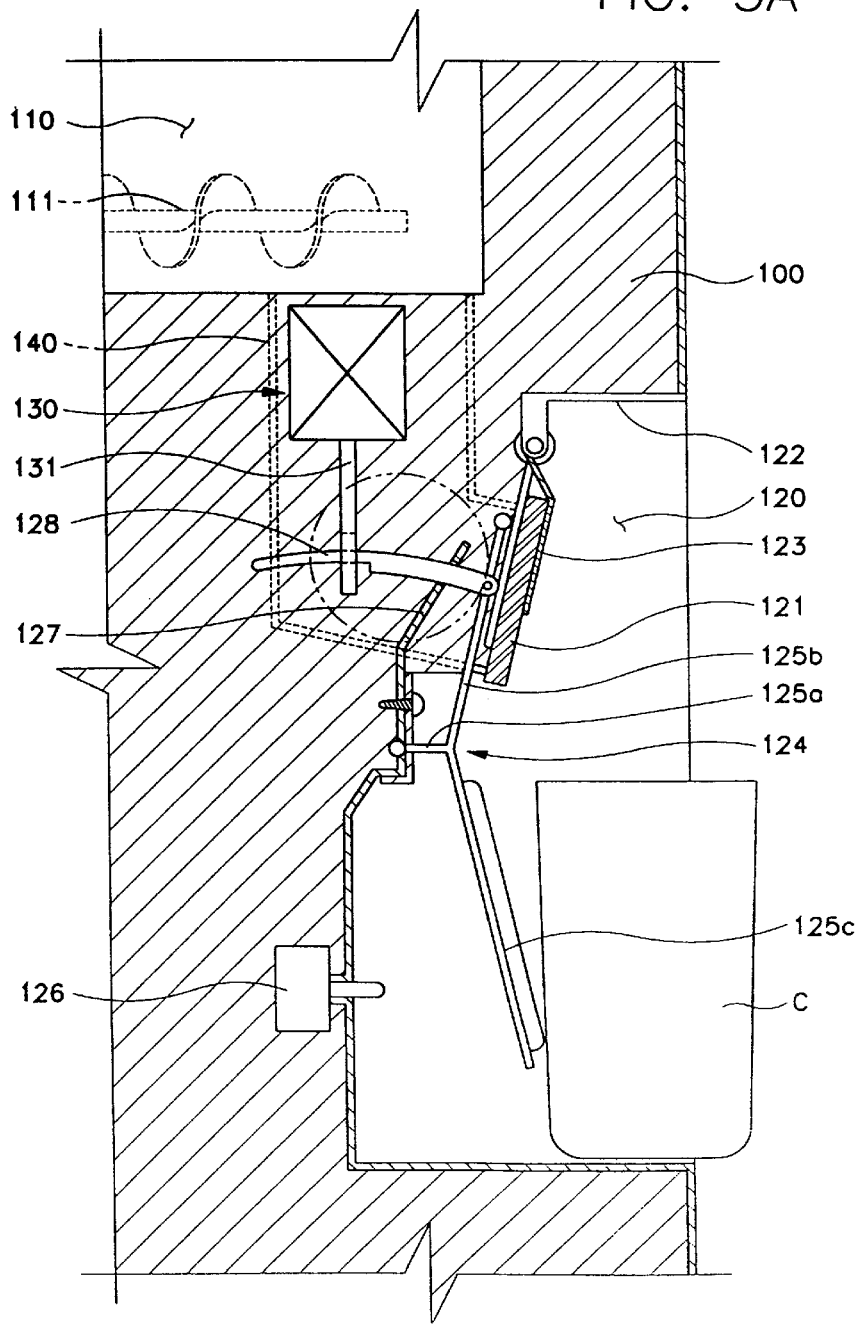
FIG. 3A is a side sectional view of an ice dispenser, in which a damper door is closed, according to a first preferred embodiment of the present invention.

FIG. 3A shows an ice dispenser according to a first preferred embodiment of the present invention. An ice reservoir 110 in which an ice supplier 111 is located is mounted inside a refrigerator, and a cavity 120 is mounted in a refrigerator door 100 so that pieces of ice can be dispensed to a cup C located within the cavity 120 in a state where the refrigerator door 100 is closed. The ice reservoir 110 communicates with the cavity 120 through an ice supply tube 140. That is, the ice supply tube 140 has an upstream end opened to the ice reservoir 110 and a downstream end opened to the cavity 120.

Fixedly mounted on a top surface of the cavity 120 is a bracket 122 on which a damper door 121 for opening and closing the downstream end of the ice supply tube 140 is pivotally mounted. An elastic member 123 is also mounted on the bracket 122 to bias the damper door 121 toward a closed position when the dispenser is not operating.

A dispenser operating lever assembly 124 is pivotally mounted on an inner wall of the cavity 120. The dispenser operating lever assembly 124 comprises a mounting lever 125*a* pivotally fixed on the inner wall of the cavity 120, a damper door opening lever 125*b* extending from an extreme end of the mounting lever 125*a* to one side of the damper door 121, and a switch operating lever 125*c* extending from the extreme end of the mounting lever 125*a* downward at a predetermined angle to the damper door opening lever 125*b*.

Mounted on the inner wall of the cavity 120 is a switch 126 which is turned ON by being pushed by the switch operating lever 125*c*. That is, when the dispenser operating lever assembly 124 pivots such that the switch operating lever 125*c* moves toward the inner wall of the cavity 120, the switch 126 is pushed by the switch operating lever 125*c* to be turned ON, thereby operating the ice supplier 111.

Describing in detail with reference to FIG. 4A, as the cup C is located into the cavity 120, the dispenser operating lever assembly 124 is pivoted. That is, the switch operating lever 125*c* is pushed by the cup C toward the inner wall of the cavity 120, and at the same, the damper door opening lever 125*b* moves to pivot the damper door 121 to an opened position while overcoming biasing force of the elastic member 123, thereby opening the downstream end of the ice supply tube 140. At this point, as described above, as the switch 126 is turned ON by being pushed by the switch operating lever 125*c* displaced toward the inner wall of the cavity 120, the ice supplier 111 is operated to dispense pieces of ice from the ice reservoir 110 to the cup C through the ice supply tube 140.

After pieces of ice are dispensed to the cup C as described above, when the cup C starts getting out of the cavity 120 as shown in FIG. 5A, since pushing force applied to the switch operating lever 125*c* by the cup C is released as the damper door opening lever 125*b* is pushed by the damper door 121 returning to its closed position by biasing force of the elastic member 123, the switch 126 is turned OFF to stop the operation of the ice supplier 111. At this point, if the damper door 121 were to abruptly close the downstream end of the ice supply tube 140, many pieces of ice which were being supplied through the ice supply tube 140 might be left within the ice supply tube 140 or be caught between the downstream end of the ice supply tube 140 and the damper door 121. To solve this problem, the dispenser according to the first preferred embodiment of the present invention provides both a retardation means for retarding the return of the damper door 121 to its closed position for a predetermined time even when the pushing force applied to the switch operating lever 125*c* by the cup C is released to turn OFF the switch 126, and a retardation release means for releasing the retardation of the return of the damper door 121 so as to return the damper door 121 to its closed position, thereby closing the ice supply tube 140.

As shown in FIG. 3B, the retardation means comprises a stopper, or stop bar, 128 pivotally coupled at its one end to the damper door opening lever 125*b* and provided with a detent step 128*a* at its lower side, and a supporting bracket 127 mounted on the inner wall of the cavity 120 for restricting the movement of the stopper 128. The supporting bracket 127 is provided with a slot 127*a* through which the stopper 128 passes. Describing more in detail, when the cup C is withdrawn out of the cavity 120 in a state where the damper door 121 is opened, the damper door 121, the damper door opening lever 125*b*, and the stopper 128 start returning to their initial positions by biasing force of the elastic member 123. At this point, a movement of the stopper 128 passing through the slot 127*a* of the supporting bracket 127 is stopped as the detent step 128*a* is caught on the supporting bracket 127. As a result, the return of the damper door 121 is stopped, thereby maintaining an opened state of the ice supply tube 140.

This opened state is maintained for a predetermined time until all pieces of ice are exhausted out of the ice supply tube 140. After the predetermined time has elapsed, the damper door 121 is returned to its closed position to close the downstream end of the ice supply tube 140. To realize this, the retardation release means comprises a solenoid 130 for elevating/lowering the stopper 128, the solenoid 130 being disposed above the stopper 128. The solenoid 130 is controlled by a microcomputer (not shown) and connected to the stopper 128 via a plunger 131. The plunger 131 is provided with a through hole 131*a* through which the stopper 128 passes. That is, as shown in FIG. 5B, when the microcomputer applies electric power to the solenoid 130 in a state where the stopper 128 is caught on the supporting bracket 127 by the detent step 128*a*, the plunger 131 moves upward, thereby elevating the stopper 128 inserted into the through hole 131*a* of the plunger 131. As a result, the detent step 128*a* caught on the supporting bracket 127 is released from the supporting bracket 127, and thus the stopper 128 completely passes through the slot 127*a* of the supporting bracket 127, thereby returning the damper door 121 to its closed position. After this, the solenoid 130 is deenergized, and the plunger 131 moves downward to its initial position.

Now the operation of the above described dispenser will be described more in detail. As shown in FIG. 3A, when the dispenser is not operating, the damper door 121 is maintained in its closed position by biasing force of the elastic member 123 to close the downstream end of the ice supply tube 140. In this state, when a user locates the cup C within the cavity 120 and pushes the switch operating lever 125*c* utilizing the cup C as shown in FIG. 4A, the switch operating lever 125*c* turns the switch 126 ON to operate the ice supplier 111 within the ice reservoir 110 and, at the same time, the damper door operating lever 125*b* is pivoted to move the damper door 121 to the opened position while overcoming the biasing force of the elastic member 123. As a result, the downstream end of the ice supply tube 140 is opened to dispense pieces of ice from the ice reservoir 110 to the cup C through the ice supply tube 140. At this point, the stopper 128 coupled to the damper door operating lever 125*b* moves in a direction where the damper door 121 is opened.

After pieces of ice are dispensed to the cup C as described above, when the cup C moves away from the switch operating lever 125*c* as shown in FIG. 5A, since pushing force applied to the switch operating lever 125*c* by the cup C is released, the dispenser operating lever assembly 124 is pivoted by the damper door 121 returning to its closed position by biasing force of the elastic member 123 and, at the same time, the switch operating lever 125*c* is moved away from the inner wall of the cavity 120 to turn OFF the switch 126, thereby stopping the operation of the ice supplier 111. At this point, a movement of the stopper 128 passing through the slot 127*a* of the supporting bracket 127 is stopped as the detent step 128*a* formed on the lower side of the stopper 128 is caught on the supporting bracket 127. As a result, the return of the damper door 121 is stopped, thereby maintaining an opened state of the ice supply tube 140 for a predetermined time preset in the microcomputer. After the predetermined time has elapsed, the microcomputer applies electric power to the solenoid 130 such that the plunger 131 moves upward to elevate the stopper 128. As a result, the detent step 128*a* is released from the supporting bracket 127, and thus the stopper 128 completely passes through the slot 127*a* of the supporting bracket 127, thereby returning the damper door 121 to its closed position to close the downstream end of the ice supply tube 140. After this, the solenoid 130 is de-energized by the microcomputer such that the plunger 131 moves downward to its initial position.

FIG. 6A shows an ice dispenser according to a second preferred embodiment of the present invention. An ice reservoir 110 in which an ice generator 111 is located is mounted inside a refrigerator, and a cavity 120 is mounted within a refrigerator door 100 so that pieces of ice can be dispensed to a cup C located within the cavity 120 in a state where the refrigerator door 100 is closed. The ice reservoir 110 communicates with the cavity 120 through an ice supply tube 140. That is, the ice supply tube 140 has an upstream end opened to the ice reservoir 110 and a downstream end opened to the cavity 120.

Fixedly mounted on a top surface of the cavity 120 is a bracket 122 on which a damper door 121 for opening and closing the downstream end of the ice supply tube 140 is pivotally mounted. An elastic member 123 is also mounted on the bracket 122 to bias the damper door 121 toward a closed position when the dispenser is not operating.

A dispenser operating lever assembly 124 is pivotally mounted on an inner wall of the cavity 120. The dispenser operating lever assembly 124 comprises a mounting lever 125*a* pivotally fixed on the inner wall of the cavity 120, a damper door opening lever 125*b* extending from an extreme end of the mounting lever 125*a* to one side of the damper door 121, and a switch operating lever 125*c* extending from the extreme end of the mounting lever 125*a* downward at a predetermined angle to the damper door opening lever 125*b*.

Mounted on the inner wall of the cavity 120 is a switch 126 which is turned ON by being pushed by the switch operating lever 125*c*. That is, when the dispenser operating lever assembly 124 pivots such that the switch operating lever 125*c* moves toward the inner wall of the cavity 120, the switch 126 is pushed by the switch operating lever 125*c* to be turned ON, thereby operating the ice supplier 111.

Describing more in detail with reference to FIG. 7A, as the cup C is located in the cavity 120, the dispenser operating lever assembly 124 is pivoted. That is, the switch operating lever 125*c* is pushed by the cup C toward the inner wall of the cavity 120, and at the same, the damper door opening lever 125*b* moves to pivot the damper door 121 to an opened position while overcoming biasing force of the elastic member 123, thereby opening the downstream end of the ice supply tube 140. At this point, as described above, as the switch 126 is turned ON by being pushed by the switch operating lever 125*c* displaced toward the inner wall of the cavity 120, the ice supplier 111 is operated to dispense pieces of ice from the ice reservoir 110 to the cup C through the ice supply tube 140.

After pieces of ice are dispensed to the cup C as described above, when the cup C starts being withdrawn out of the cavity 120 as shown in FIG. 8A, since pushing force applied to the switch operating lever 125*c* by the cup C is released, the dispenser operating lever assembly 124 is pivoted by the damper door 121 returning to its closed position by biasing force of the elastic member 123 and, at the same time, the switch operating lever 125*c* is moved away from the inner wall of the cavity 120 to turn OFF the switch 126, thereby stopping the operation of the ice supplier 111. At this point, if the damper door 121 were to abruptly close the downstream end of the ice supply tube 140, many pieces of ice which were being supplied through the ice supply tube 140 might be left within the ice supply tube 40 or be caught between the downstream end of the ice supply tube 140 and the damper door 121. To solve this problem, the dispenser according to the second preferred embodiment of the present invention provides both a retardation means for retarding the return of the damper door 121 to its closed position for a predetermined time even when the pushing force applied to the switch operating lever 125*c* by the cup C is released to turn OFF the switch 126, and a retardation release means for releasing the retardation of the return of the damper door 121 so as to return the damper door 121 to its closed position, thereby closing the ice supply tube 140.

As shown in FIG. 6B, the retardation means comprises a stopper 228 pivotally coupled at its one end to the damper door opening lever 125*b* and provided with a detent step 228*a* at its upper side, and a supporting bracket 227 mounted on the inner wall of the cavity 120 for restricting the movement of the stopper 228. The supporting bracket 227 is provided with a slot 227*a* through which the stopper 228 passes. And, the retardation release means comprises a solenoid 230 for elevating/lowering the stopper 228, the solenoid 230 being disposed above the stopper 228. The solenoid 230 is controlled by a microcomputer (not shown) and connected to the stopper 228 via a plunger 231. The plunger 231 is provided with a through hole 231*a* through which the stopper 228 passes. A roller 232 is disposed in the through hole 231*a* to smoothly move the stopper 228. Describing more in detail with reference to FIG. 7A, as the cup C is located in the cavity 120, the damper door opening lever 125*b* moves to pivot the damper door 121 to an opened position, and the stopper 228 coupled to the damper door opening lever 125*b* also moves in a direction where the damper door 121 is opened. At the same time, the microcomputer applies electric power to the solenoid 230 such that the plunger 231 moves upward to elevate the stopper 228. As a result, when the cup C is withdrawn out of the cavity 120 in a state where the damper door 121 is opened, the damper door 121, the damper door opening lever 125*b*, and the stopper 228 start returning to their initial positions by biasing force of the elastic member 123. At this point, a movement of the stopper 228 passing through the slot 227*a* of the supporting bracket 227 is stopped as the detent step 228*a* formed on the upper side of the stopper 228 is caught on the supporting bracket 227. As a result of this, the return of the damper door 121 is stopped, thereby maintaining an opened state of the ice supply tube 140.

This opened state is maintained for a predetermined time until all pieces of ice are exhausted out of the ice supply tube 140. After the predetermined time has elapsed, the solenoid 230 is de-energized by the microcomputer such that the plunger 231 moves downward, thereby lowering the stopper 228 inserted into the through hole 231*a* of the plunger 231. As a result, the detent step 228*a* is released from the supporting bracket 227 as shown in FIG. 8B, and thus the stopper 228 completely passes through the slot 227*a* of the supporting bracket 227, thereby returning the damper door 121 to its closed position.

Now the operation of the above described dispenser will be described hereinafter more in detail. As shown in FIG. 6A, when the dispenser is not operating, the damper door 121 is maintained in its closed position by biasing force of the elastic member 123 to close the downstream end of the ice supply tube 140. In this state, when a user locates the cup C within the cavity 120 and pushes the switch operating lever 125*c* utilizing the cup C as shown in FIG. 7A, the switch operating lever 125*c* turns the switch 126 ON to operate the ice supplier 111 within the ice reservoir 110 and, at the same time, the damper door operating lever 125*b* is pivoted to move the damper door 121 to the opened position while overcoming the biasing force of the elastic member 123. As a result, the downstream end of the ice supply tube 140 is opened to dispense pieces of ice from the ice reservoir 110 to the cup C through the ice supply tube 140. At this point, the stopper 228 coupled to the damper door operating lever 125*b* moves in a direction where the damper door 121 is opened and, at the same time, the microcomputer applies electric power to the solenoid 230 such that the plunger 231 moves upward to elevate stopper 228.

After pieces of ice are dispensed to the cup C as described above, when the cup C starts being withdrawn out of the cavity 120 as shown in FIG. 8A, since pushing force applied to the switch operating lever 125*c* by the cup C is released, the dispenser operating lever assembly 124 is pivoted by the damper door 121 returning to its closed position by biasing force of the elastic member 123 and, at the same time, the switch operating lever 125*c* is moved away from the inner wall of the cavity 120 to turn OFF the switch 126, thereby stopping the operation of the ice supplier 111. At this point, a movement of the stopper 228 passing through the slot 227*a* of the supporting bracket 227 is stopped as the detent step 228*a* formed on the upper side of the stopper 228 is caught on the supporting bracket 227. As a result, the return of the damper door 121 is stopped, thereby maintaining an opened state of the ice supply tube 140 for a predetermined time preset in the microcomputer. After the predetermined time has elapsed, the solenoid 230 is de-energized by the microcomputer such that the plunger 231 moves downward to lower the stopper 228. As a result, the detent step 228*a* is released from the supporting bracket 227, and thus the stopper 228 completely passes through the slot 227*a* of the supporting bracket 227, thereby returning the damper door 121 to its closed position to close the downstream end of the ice supply tube 140.

As described above in detail, the ice dispenser of a refrigerator according to the present invention is provided with a stopper having a detent step for retarding the return of a damper door, and a solenoid for releasing retardation state of the stopper. By this structure, to release the retardation state of the stopper, electric power is temporarily applied to the solenoid as described in the first preferred embodiment, thereby reducing electric power consumption compared to an actuator which operates the damper door. Also, although electric power is continually applied to the solenoid during the opened state of the damper door as described in the second preferred embodiment, a relatively small amount of operating force of the solenoid is required to only elevate or lower the stopper to the height of the detent step, thereby minimizing the capacity of the solenoid and improving the operational reliability of the dispenser.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A through-the-door ice dispenser for a refrigerator, comprising:

a refrigerator door having a cavity in the front of the door;

an ice reservoir mounted inside the refrigerator;

an ice supplier disposed within the ice reservoir;

an ice supply tube connecting the ice reservoir with the cavity of the refrigerator door;

a damper door in the cavity of the refrigerator door, for closing the ice supply tube when ice is not being dispensed;

an elastic member biasing the damper door toward a position closing the ice supply tube;

a switch disposed in the cavity of the refrigerator door, for operating the ice supplier when the switch is depressed;

a microprocessor electrically connected to the switch;

a switch operating lever in the cavity of the refrigerator door, for contacting the switch when the switch operating lever is pushed for the dispensing of ice;

mechanical opening means for opening the damper door in response to pushing of the switch operating lever;

mechanical stopping means for stopping the damper door in the open position after the damper door is opened; and electrical releasing means for releasing the mechanical stopping means in response to a signal from the microprocessor.

2. The through-the-door ice dispenser of claim 1, further comprising:

delaying means within said microprocessor for sending said signal to said electrical releasing means when a predetermined time has elapsed after said switch is undepressed.

3. The through-the-door ice dispenser of claim 1, further comprising:

said electrical releasing means comprising a solenoid connected to the mechanical stopping means.

4. A through-the-door ice dispenser for a refrigerator, comprising:

a refrigerator door having a cavity in the front of the door;

an ice reservoir mounted inside the refrigerator;

an ice supplier disposed within the ice reservoir;

an ice supply tube connecting the ice reservoir with the cavity of the refrigerator door;

a damper door in the cavity of the refrigerator door, for closing the ice supply tube when ice is not being dispensed;

an elastic member biasing the damper door toward a position closing the ice supply tube;

a switch disposed in the cavity of the refrigerator door, for operating the ice supplier when the switch is depressed;

a microprocessor electrically connected to the switch;

a switch operating lever pivotally mounted in the cavity of the refrigerator door, for depressing the switch when the switch operating lever is pushed for the dispensing of ice;

a damper door opening lever extending from an end of the switch operating lever and connected to the damper door, for opening the damper door in response to pushing the switch operating lever;

a stop bar pivotally coupled to the damper door opening lever;

a supporting bracket mounted in the refrigerator door for restricting the movement of the stop bar when the damper door moves toward the closed position; and a solenoid having a plunger contacting said stop bar, said solenoid electrically connected to said microprocessor.

5. The through-the-door ice dispenser of claim 4, further comprising: said supporting bracket having a slot through which the stop bar passes.

6. The through-the-door ice dispenser of claim 4, further comprising:

said stop bar having a detent step for catching on the supporting bracket when the damper door is moved toward the closed position.

7. The through-the-door ice dispenser of claim 4, further comprising:

said detent step being formed on the lower side of said stop bar.

8. The through-the-door ice dispenser of claim 7, further comprising:

said solenoid being oriented to move said stop bar-upwards when the solenoid is energized.

9. The through-the-door ice dispenser of claim 8, further comprising:

said microprocessor having means for briefly energizing the solenoid when a predetermined time has elapsed after the switch is undepressed.

10. The through-the-door ice dispenser of claim 4, further comprising:

said detent step being formed on the upper side of said stop bar.

11. The through-the-door ice dispenser of claim 10, further comprising:

said solenoid being oriented to move said stop bar upward when the solenoid is energized.

12. The through-the-door ice dispenser of claim 11, further comprising:

said microprocessor having means for energizing the solenoid after the switch is depressed, for raising the stop bar upward into position to catch the detent on the supporting bracket when the door is closing.

13. The through-the-door ice dispenser of claim 12, further comprising:

said microprocessor having means for de-energizing the solenoid when a predetermined time has elapsed after the switch is undepressed.

14. The through-the-door ice dispenser of claim 13, further comprising:

a roller mounted on the hole of the plunger for facilitating movement of the stop bar.

15. The through-the-door ice dispenser of claim 4, further comprising:

said plunger of said solenoid having a hole through which the stop bar passes.

16. The through-the-door ice dispenser of claim 4, further comprising:

said solenoid being mounted above said stop bar.

* * * * *